United States Patent [19]

Przewalski

[11] 4,245,571

[45] Jan. 20, 1981

[54] THERMAL REDUCTOR SYSTEM AND METHOD FOR RECOVERING VALUABLE METALS FROM WASTE

[75] Inventor: Zygmunt J. Przewalski, Windsor, Conn.

[73] Assignee: T R Systems, Inc., Glastonbury, Conn.

[21] Appl. No.: 893,621

[22] Filed: Apr. 5, 1978

[51] Int. Cl.[2] ..... F23G 5/06

[52] U.S. Cl. ..... 110/246; 110/212; 110/216

[58] Field of Search ..... 110/212, 246, 216, 234, 110/254

[56] References Cited

U.S. PATENT DOCUMENTS

| | | | |
|---|---|---|---|
| 1,698,454 | 1/1929 | Shaaf | 110/215 |
| 2,082,870 | 6/1937 | Caffrey | 110/246 |
| 2,269,273 | 1/1942 | Krogh et al. | 110/246 |
| 3,716,339 | 2/1973 | Shigaki et al. | 110/226 |
| 3,794,565 | 2/1974 | Bielski et al. | 110/254 |
| 3,848,548 | 12/1974 | Bolejack, Jr. et al. | 110/212 |
| 3,859,933 | 1/1975 | Von Klenck | 110/226 |
| 3,861,335 | 1/1975 | Przewalski | 110/246 |

*Primary Examiner*—Edward G. Favors
*Attorney, Agent, or Firm*—Hayes & Reinsmith

[57] ABSTRACT

A thermal reductor system is provided with a rotary ignition chamber having an input end, a discharge end of enlarged size relative to the input end and an inside chamber wall having a configuration for promoting natural flow of gases, smoke and ash discharge from the input end to the discharge end. To limit discharge of solid residue to a maximum predetermined size, the discharge end of the chamber is provided with a restricted ash exit. So that the ignition chamber is particularly suited for disposing of liquid wastes in a compact chamber construction, the inside chamber wall has a restriction intermediate the input and discharge ends of the chamber defining a barrier to liquid flow. An exhaust duct is provided for the passage of gases and smoke from the ignition chamber. The duct is connected to a downstream filter unit for cleaning the volatilized products of combustion, and a heat exchanger is connected to the duct upstream of the filter unit for cooling the combustion products before filtering and which may also be used for generating heated make-up air for delivery to a burner for the ignition chamber.

18 Claims, 4 Drawing Figures

THERMAL REDUCTOR SYSTEM AND METHOD FOR RECOVERING VALUABLE METALS FROM WASTE

This invention generally relates to waste disposal systems and to a valuable metal production process wherein heat is used as a means of separating metal from a waste carrier. This invention is more particularly directed to a new and improved thermal reductor system having a rotary ignition chamber generally of a type described in U.S. Pat. No. 3,861,335 issued Jan. 21, 1975 to Zygmunt J. Przewalski and assigned to the assignee of this invention.

A primary object of this invention is to provide a new and improved thermal reductor system for disposing of industrial residue and having waste consumption capabilities for meeting a wide variety of demanding applications for both liquid and solid waste disposal in an efficient effective process with environmentally acceptable stack emissions.

Another object of this invention is to provide a system of the above described type which will effect low cost efficient recovery of valuable metallic oxides from disposal processing of metal bearing waste from manufacturing operations. Included in this object is the aim of providing a system capable of highly efficient recovery of tin oxide from various tin compounds found in waste from tin plating operations and tin compound manufacturing operations.

A further object of this invention is to provide a new and improved thermal reductor system particularly suited to effect an overall efficiency of operation to provide recovery of at least 95% of metallic oxide residue resulting from the disposal of metal bearing waste consumed in the disposal process.

Another object of this invention is to provide a new and improved high capacity rotary thermal reductor unit which has a simplified but significantly compact construction particularly suited for continuous, efficient disposal of slurries and other industrial waste by-products such as sludges having relatively high liquid content.

Yet another object of this invention is to provide a new and improved method of disposing of industrial residues and various slurries, sludges and the like which is not only efficient but effects significantly improved recovery of the metallic content of metal bearing waste material. Included in this object is the aim of providing a low cost efficient method of recovering tin oxide resulting from disposal processing of various tin compounds and which will effect 95% or greater recovery of tin content of the materials deposited for processing.

Other objects will be in part obvious and in part pointed out in more detail hereinafter.

A better understanding of the objects, advantages, features, properties and relations of the invention will be obtained from the following detailed description and accompanying drawings which set forth an illustrative embodiment and is indicative of the ways in which the principles of the invention are employed.

Figure 1:
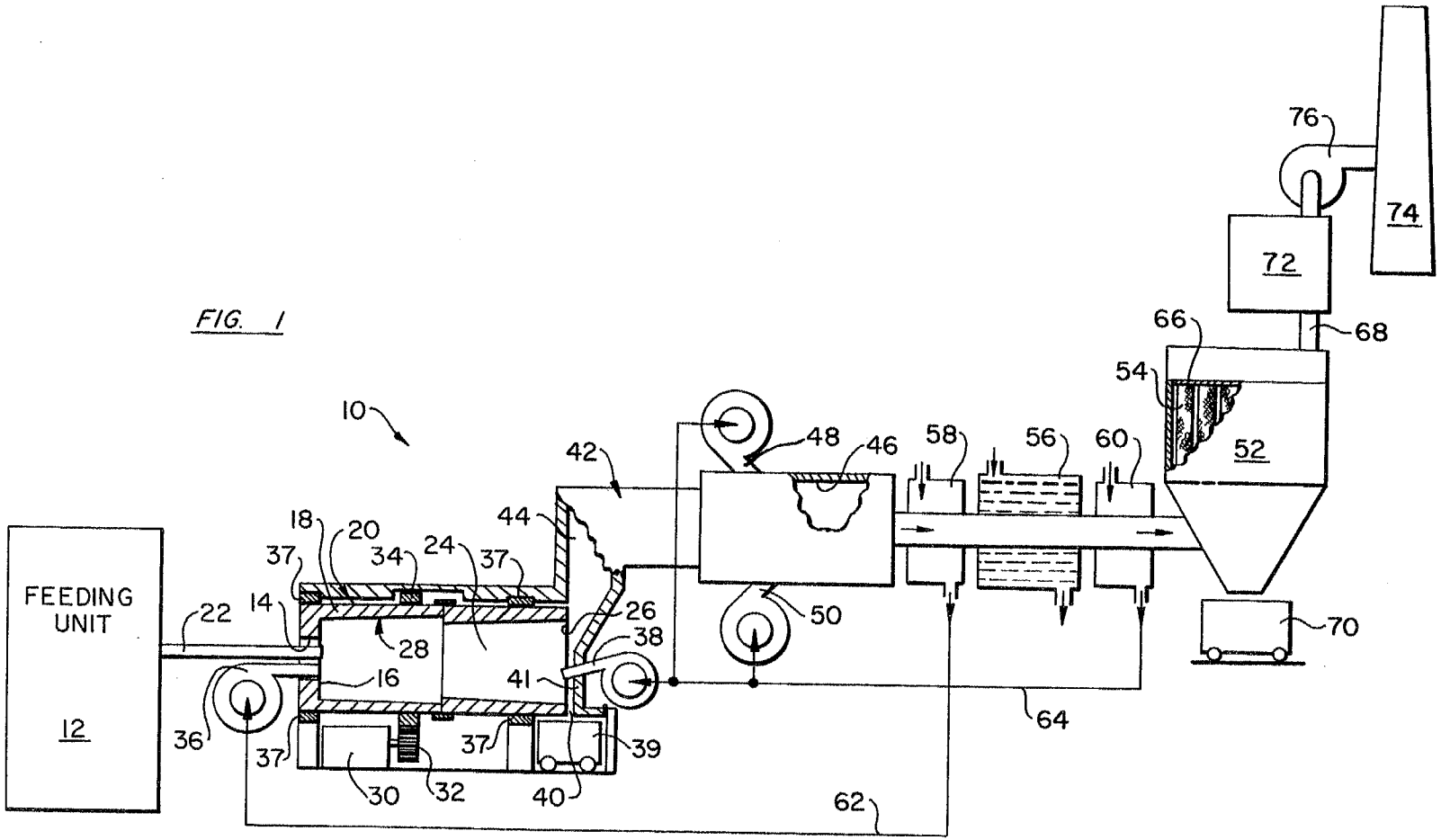
FIG. 1 is a schematic view, partly broken away and partly in section, illustrating a thermal reductor system particularly suited to effect waste disposal in accordance with this invention.
Figure 2:
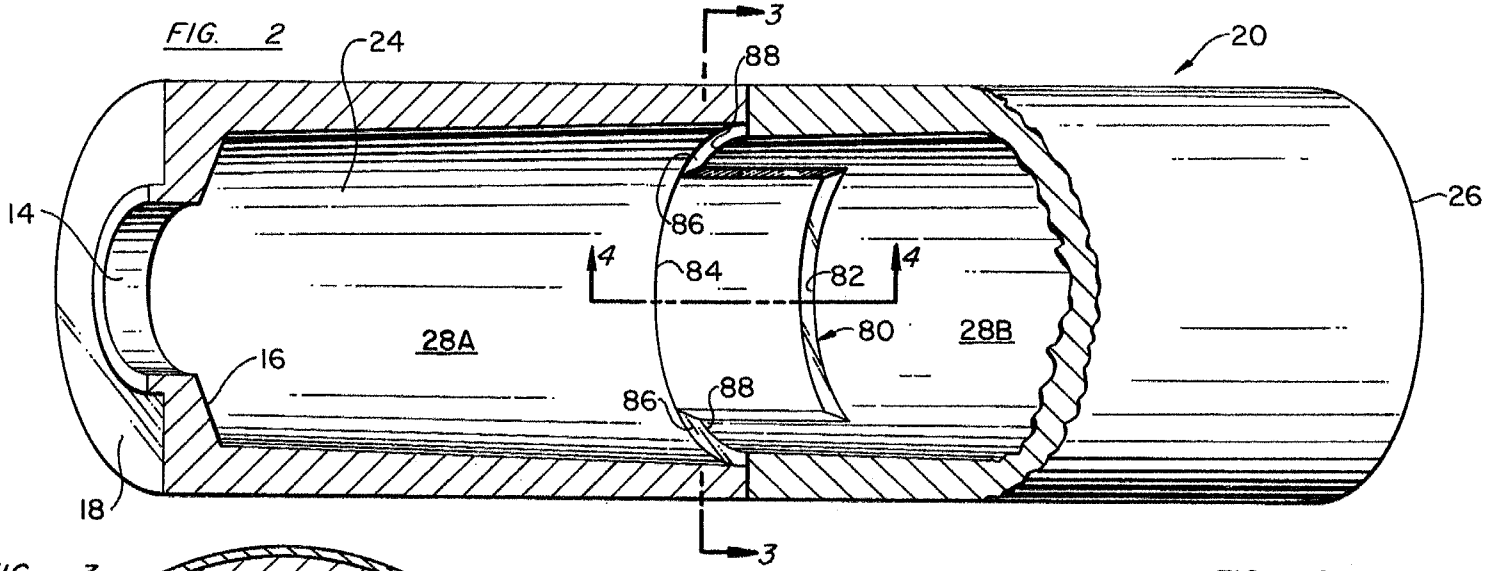
FIG. 2 is an isometric view, partly broken away and partly in section, showing an ignition chamber embodying certain features of this invention.

Referring to the drawings in detail, a thermal reduction system 10 is illustrated in FIG. 1 particularly suited for disposing of waste in liquid or solid or mixed form. Any suitable waste feeding unit 12 is provided, e.g., by conventionally available equipment or combination of devices such a screw conveyor, mechanical pusher, pumping apparatus and/or liquid atomizing devices for supplying waste through an opening 14 in an input end 16 of a housing 18 for a rotary reduction unit 20 of the general type described in my above referenced U.S. Pat. No. 3,861,335, the subject matter of which is incorporated herein by reference. A suitable waste inlet chute 22 is shown provided between the waste feeding unit 12 and an internal ignition chamber 24 within housing 18 for feeding raw waste material into the unit 20 for incineration. Housing 18 has a restricted discharge end 26 of enlarged size relative to its input end 16 and an inside chamber wall 28 extends between ends 16, 26 of the ignition chamber 24 to promote natural flow of gases, unconsumed particulate or smoke, and ash discharge toward the enlarged discharge end 26.

Suitable drive means including motor 30 is mounted adjacent housing 18 and is provided with a drive gear 32 which meshes with a driven gear 34 secured to a generally cylindrical exterior of housing 18. Suitable rollers, not shown, are mounted on floor supports for engaging axially spaced guide tracks, not shown, circumferentially extending about housing 18 to support the housing for horizontal rotation about a longitudinally extending axis of the chamber as fully described in my above referenced U.S. Pat. No. 3,861,335.

To effect the most efficient burning of the waste fed into the ignition chamber 24, flame is directed into a selected one or both of its input and discharge ends, depending on the conditions required by the specific waste materials, by burners 36 and 38 suitably mounted on framework, not shown, for the system 10. Burners 36, 38 are appropriately positioned to create a turbulent condition within the ignition chamber 24 during burner operation to optimize the combustion process. In the preferred embodiment, the ignition chamber 24 is preferably preheated by the burners 36 and 38 to operating temperature prior to operating the feeding unit 12 to charge waste into the ignition chamber 24. The operating temperature within the ignition chamber 24 for tin bearing waste compounds, e.g., is preferably maintained between a normal minimum temperature of about 800° F. to a normal maximum temperature of about 1800° F., although it is to be understood that other materials to be consumed in the ignition chamber 24 may require much higher temperatures, say, to about 3000° F., typically, depending upon the material and rotational speed of the chamber housing 18.

The waste which is first fed into the input end 16 of the ignition chamber is incinerated therein, abrasively tumbled and automatically advanced toward discharge end 26 by rotating the housing 18, say, one revolution per five minutes, due to the illustrated frustoconical configuration of chamber 18. Controlled penetration of underfire air and restricted flow of overfire air, preferably under a starved air condition, provides for burning of the exposed surfaces of the waste while its undersurfaces contacting the chamber refractory surfaces are undergoing pyrolysis. Rotation of housing 18 on its bearing supports 37, which rotation may be in either of two selected angular directions during the described thermal reduction process, continuously exposes new refractory surfaces under the waste streams and also agitates and breaks up any insulating ash layer of solid waste products. Solid noncombustibles settle to the bottom of the rotating housing 18 and are continuously discharged and collected from system 10 in a suitable container 39 through a restricted ash exit or slot 40 at discharge end 26. To ensure that only solid residue of a predetermined maximum size is released from housing 20, a discharge end wall is shown at 41 at the chamber discharge end 26 to define restricted ash exit 40. It will be understood that end wall 41 may be provided with adjustment means, not shown, for selectively adjusting the size of the slot opening 40 to optimize the incineration process within chamber 24 under varying conditions.

Accordingly, slot 40 permits only a restricted air flow while maintaining the starved air condition within chamber 24. By maintaining the reductor chamber temperature in the above noted 800° F. to 1800° F. range, it has been found that the system serves as a unique production process to recover valuable metals from various waste materials on an efficient basis while thermally disposing of the waste stream.

An exhaust passage is provided by insulated duct (generally designated at 42 in FIG. 1) for receiving the exhaust gases and smoke exiting from the ignition chamber 24. The volatilized products of combustion are directed into a mixing chamber or flue 44 of duct 42 before being ultimately exhausted to atmosphere. Flue 44 communicates with an inlet of a stationary oxidation chamber 46 connected to the exhaust duct 42. Oxidation chamber 46 is normally preheated to an operating temperature elevated in relation to the operating temperature within the rotary ignition chamber 24. The combustion process within the oxidation chamber 46 further thermally oxidates unconsumed particulates in the volatilized combustion products exhausted from the ignition chamber 24. In processing the above noted tin bearing waste streams, it has been found satisfactory to permit the temperature within the oxidation chamber 46 to vary between a normal minimum of about 1800° F. to a normal maximum temperature of about 2100° F. To optimize turbulence and combustion of the unconsumed particulates in the oxidation chamber 46, first and second afterburners 48 and 50 are preferably mounted on the system framework, not shown, to direct flames into the oxidation chamber 46 from diametrically opposed sections of the chamber wall.

To effect low cost and significantly improved efficiency of recovery of metallic oxides, e.g., from various metal bearing waste sludges and streams to be processed, a commercially available bag house 52, utilizing conventional filter media is provided downstream of the outlet from the oxidation chamber 46 to remove any particulates carried by the gases and smoke discharged from the oxidation chamber 46. To minimize any damage to filter 54, e.g., which may be mounted in the bag house 52 to effect particulate filtration, and to also additionally conserve energy by generating steam for auxiliary applications, a conventional air-to-water multitube heat exchanger unit 56 may be connected to duct 42. The heat exchanger 56 is positioned in the system 10 between the oxidation chamber 46 and the bag house 52 so as to use the heat content of the gases from the oxidation chamber to generate steam available, e.g., for auxiliary plant process needs. The heat exchanger 56 preferably has sufficient surface area to extract waste heat and cool the gases exhausted from oxidation chamber 46, upon their being passed through the heat exchanger 56, to a maximum effluent air temperature, say, below 400° F. The temperature of the gases may be further reduced if desired by the provision of fuel economizer units 58 and 60 shown connected to the duct 42. The fuel economizer unit 58 is located in the system 10 between the oxidation chamber 46 and the heat exchanger 56, and unit 60 is shown positioned between heat exchanger 56 and bag house 52.

To decrease the effluent air temperature so that it can be introduced into bag house 52 without damaging the filter media or bags 54 which are preferably used, as well as to reduce auxiliary fuel consumption and to maximize the overall system efficiency, each unit 58 and 60 preferably comprises an air-to-air heat exchanger with a motorized fan to supply heated make-up air through return ducts 62 and 64 to the ignition burners 36, 38 and combustion afterburners 48, 50 of the ignition and oxidation chambers 24, 46. This heated make-up air not only serves to preheat the chamber 24, 46 and minimize fuel consumption but also has been found effective in increasing evaporation of waste liquids upon entering the ignition chamber 24.

Conventionally available filter tubes 54 are preferably mounted in the bag house 52 and are normally held by wire frames, not shown, arranged in rows to depend vertically from an overlying plate 66 to retain metallic oxides such as tin oxide particles on the outer surface of the filter tubes 54 during air passage through bag house 52. While the filter material selected for different applications may be of a variety of different materials such as "Dacron" or "Teflon", e.g., nonwoven felted nylon tubes have been found to satisfactorily filter tin oxides. The clean air passes through the filter bags or tubes 54 and into an upper plenum chamber within the bag house 52 and out through a downstream section 68 of duct 42.

After the gases exhausted from the oxidation chamber 46 are cooled and filtered, the particulate solid noncombustible matter is periodically removed from the bag house 52 by any suitable conventional means, e.g., by a timed air pulse jet system, to provide a continuous self-cleaning operation to remove accumulated dust from the bags 54. In the process described of disposing of tin bearing waste streams, tin oxide particulate is collected in a suitable external residue collector 70 shown positioned below a lower discharge end of bag house 52.

By virtue of the above described apparatus and process of this invention, it has been found that the recovery, for example, of tin oxide from various sludges and slurries bearing tin compounds has resulted in an overall operating efficiency to effect 95% or more tin oxide recovery.

Upon being passed through the bag house 52, the gases may be further cleaned of any contaminates therein by passing the gases through duct section 68 connected to a gas scrubber 72 such as that fully illustrated and described in U.S. Pat. 3,994,705 issued Nov. 30, 1976 to Zygmunt J. Przewalski and assigned to the assignee of this invention, the subject matter of which is incorporated herein by reference. The gas received from bag house 52 enters an inlet tube connected to exhaust duct section 68 and is centrifugally accellerated within a treatment chamber to precipitate suspended matter out of the gases such that mist-free gases move in swirling fashion upwardly toward a clean gas outlet located within the upper part of the scrubber 72. Upon reaching the outlet, clean gases are drawn through an exhaust stack 74 with the assistance of a power operated exhaust fan 76 operatively connected in the duct 42.

The exhaust fan 76 not only exhausts clean effluent gases to atmosphere after being filtered and scrubbed but additionally and simultaneously provides an induced draft so as to draw air through the entire system 10 to create a negative pressure condition in the system 10 to maximize the efficiency of the above described thermal reduction process.

Figure 4:
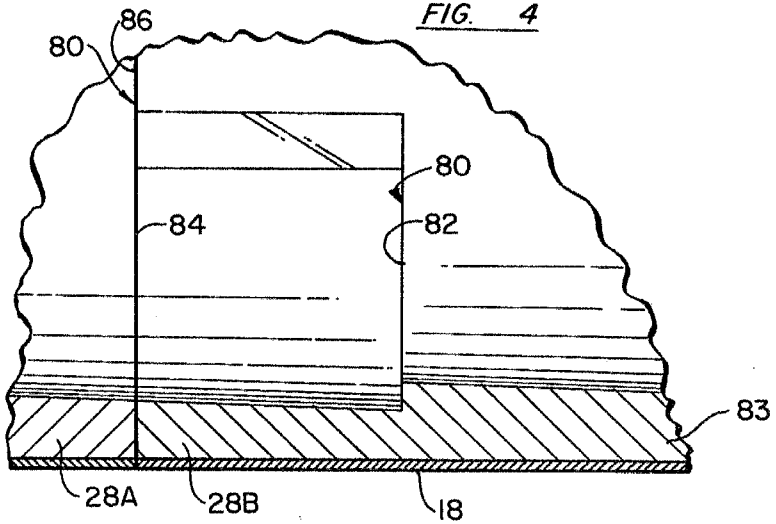
FIG. 4 is an enlarged sectional view, partly broken away, taken generally along line 4—4 of FIG. 2.
Figure 3:
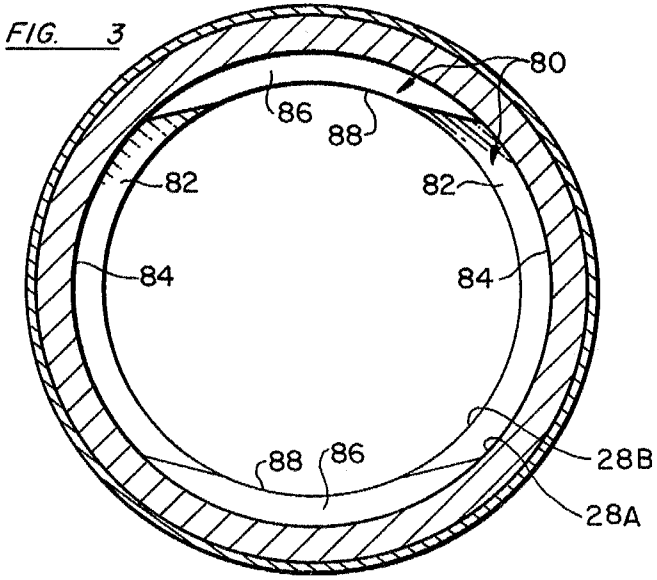
FIG. 3 is a sectional view taken generally along line 3—3 of FIG. 2.

It is to be understood that the thermal reductor system and process of this invention is particularly suited to efficiently dispose of various sludges which may be supplied from filters, pond muds and still bottoms by the described combustion process. In encountering varieties of combustible, noncombustible and mixed components which may be highly toxic, corrosive liquids or solids, slurries and the like, the liquid content of such waste material has frequently created significant problems in effectuating a complete combustion process within a primary incinerating chamber. To dispose of such waste streams, particularly those having a high liquid content, the inside wall 28 of ignition chamber 24 is provided with a restriction 80 intermediate the input and discharge ends 16, 26 which restriction 80 defines a barrier to liquid flow toward the discharge end 26 of chamber 24. In the specifically illustrated embodiment, the ignition chamber 24 has a continuous lining 83 (FIG. 4) provided by at least two longitudinally extending coaxially aligned segments 28A, 28B each having a frustoconical inside wall configuration. Segments 28A, 28B are formed of a suitable refractory material such as a high temperature low iron alumina castable material of medium density. One segment 28B is illustrated as being downstream of the other segment 28A and tapers from the open discharge end 26 of chamber 24 toward restriction 80 and the other segment 28A tapers away from the restriction 80 toward input end 16. More specifically, restriction 80 is defined in part by lips 82, 82 which project generally radially inwardly from diametrically opposed recessed upstream wall sections of segment 28B. Lips 82, 82 each form a stepped juncture between their respective downstream chamber wall and recessed upstream wall sections of segment 28B which taper toward and smoothly merge with segment 28A along lines 84, 84. Between lips 82, 82 at the joint between segments 28A and 28B are shoulders 86, 86 extending along arcuate lines 88, 88 coincident with the minimum inside diameter of chamber segment 28B. By virtue of the above structure, shoulders 86, 86 and lips 82, 82 jointly cooperate in longitudinally spaced alternating relation to define restriction 80 forming a liquid flow barrier of minimum inside diameter within chamber 24 between its input and discharge ends 16 and 26.

The height of restriction 80 and the number of its lips or shoulders may be varied with regard to the type of material to be reduced within ignition chamber 24, the operating temperature, the extent of the waste liquid content, the flow rate of the waste stream through the chamber 24 and the angular speed of the ignition chamber housing which typically may be about one revolution in five minutes time for a six foot diameter chamber. The chamber of the described rotary housing having a liquid flow barrier of the type disclosed has been found to be of significant benefit in providing for normal advance movement of solids along the chamber wall toward discharge end 26 and ensuring against discharge of liquid waste while at the same time providing a chamber having seemingly incompatible advantages, namely, increased capacity and increased rate of waste consumption in a chamber structure of reduced length and cost.

Charging of ignition chamber 24 may be either on a continuous or batch feed basis which can be adjusted to the speed of rotation and to the temperature for optimum continuous operation waste processing. Likewise operation of the burners for the described chambers is intermittent on a demand basis once operating temperature is reached within the chambers. The above summary of operation does not specifically describe certain details of various controls, circuitry and piping arrangements and which have been found to operate satisfactorily, for a variety of different circuits and controls may be employed in accordance with conventional techniques to effect system operation on manual, semi-automatic or automatic process sequencing.

The operation of the system in accordance with the above described construction and process has been found to effectively reduce solids, liquids and combination thereof in sludge form and to enhance the recoverability of valuable material therein and thereby increase the "richness" of the ash content in addition to specifically recovering metallic oxide particulates from the volatilized products of combustion in the filtration unit after the products have been cooled through the heat exchanger. Silver cyanide solutions, for example, have been effectively processed with recovery of silver salts and silver metal. Tin compounds, waxes, paints, chlorinated hydrocarbons, filter papers, x-ray and tungsten films, cobalt residue from nuclear processes, metal "fluff" from various scrap recovery programs, zirconium and phosphorous waste are but examples of other industrial residue or waste materials which have been satisfactorily treated, detoxified, disposed of and, where feasible, have resulted in a highly satisfactory degree of residue recovery while at the same time fully complying with pollution control standards for incinerator installations so as to provide smoke-free and odor-free affluent. In addition, the use of the disclosed segmented truncated interior wall construction in the ignition chamber has provided an exceptionally compact incinerator unit of reduced length particularly suited for liquid processing with increased capacity in a simplified but highly efficient construction.

As will be apparent to persons skilled in the art, various modifications, adaptations and variations of the foregoing specific disclosure can be made without departing from the teachings of the present invention.

I claim:

1. In a thermal reductor system for waste disposal, a rotary housing having a longitudinally extending ignition chamber, and means supporting the housing for rotation about a horizontal axis, the ignition chamber having an input end, a discharge end and an inside chamber wall extending between the ends of the ignition chamber, the inside chamber wall being tapered from the discharge end toward the input end for promoting natural flow of gases, smoke and ash discharge toward said discharge end, the inside chamber wall having a restriction of minimum diameter intermediate the input and discharge ends of the chamber defining a barrier to liquid flow from the input to discharge ends of the chamber while permitting normal advance movement of solids along the inside chamber wall toward the discharge end.

2. The apparatus of claim 1 wherein the ignition chamber includes a continuous lining provided by at least two longitudinally extending coaxially aligned segments formed of refractory material, one segment being downstream of the other segment and tapering from the open discharge end of the chamber toward said restriction within the chamber, said other segment tapering away from said restriction toward the input end of the ignition chamber.

3. The apparatus of claim 2 wherein the segments each have a frustoconical inside wall configuration.

4. The apparatus of claim 1 or claim 2 wherein the restriction is defined by a projection extending generally radially inwardly from the inside chamber wall.

5. The apparatus of claim 1 wherein the horizontal axis of rotation is coincident with a longitudinally extending axis of the ignition chamber.

6. A thermal reductor system for waste disposal comprising a housing having a horizontally disposed longitudinally extending ignition chamber supported for rotation about its longitudinal axis, the housing having an input end, a discharge end of enlarged size relative to its input end, and an inside chamber wall extending between the ends of the ignition chamber for promoting natural flow of gases, smoke and ash discharge toward said enlarged discharge end, exhaust duct means connected to the discharge end of the ignition chamber providing a passage for volatilized gases and smoke from the ignition chamber, a heat exchanger connected to the duct means for cooling gases downstream of the ignition chamber, and filter bag means connected to the duct means downstream of the heat exchanger for collecting metallic oxide particles from gases passing through the filter bag means.

7. The system of claim 6 further including an oxidation chamber connected to the duct means between the ignition chamber and the heat exchanger, the oxidation chamber having an afterburner for raising the temperature in the oxidation chamber above the temperature of the ignition chamber to thermally oxidate unconsumed particulates in the gases and smoke received from the ignition chamber.

8. The system of claim 7 further including a burner in the ignition chamber, an air preheating device in the duct means downstream of the oxidation chamber, a return duct connecting the air preheating device to said burner and afterburner and including a power operated fan unit for directing heated make-up air from the air preheating device through the return duct to the burner and afterburner of the ignition and oxidation chambers.

9. The system of claim 6 further including a fan unit in the exhaust duct means downstream of the filter bag means for exhausting clean effluent gases to atmosphere and simultaneously drawing air through the system to create a negative pressure condition in the system.

10. The system of claim 6 further including a gas scrubber connected to the exhaust duct means downstream of the filter bag means for cleaning contaminants from gases exhausted from the filter bag means before being released to atmosphere.

11. The system of claim 6 further including waste feeding means for feeding metal bearing waste into the input end of the chamber, power driven means for rotating the ignition chamber at a predetermined angular velocity in timed relation to the waste feeding means to abrasively tumble and automatically advance waste along the length of the chamber from its input end to its discharge end, and external residue collection means for receiving discharge ash and solid noncombustibles automatically released from the discharge end of the chamber during its rotation.

12. The apparatus of claim 1 or claim 6 further including a discharge end wall cooperating with the chamber housing to define an ash exit opening limiting discharge of solid material from the chamber to a predetermined maximum size.

13. In a thermal reductor system for waste disposal, a rotary housing having a longitudinally extending ignition chamber, and means supporting the housing for rotation about a horizontal axis, the ignition chamber having an input end, a discharge end of enlarged size relative to its input end and a wall extending between the ends of the ignition chamber for promoting natural flow of gases, smoke and ash discharge toward said enlarged discharge end, the inside wall having a plurality of radial shoulders formed in alternating longitudinally offset relation to one another intermediate the input and discharge ends of the chamber defining a barrier to liquid flow from the input to discharge ends of the chamber, the shoulders being circumferentially arranged such that a projection of the shoulders in a plane normal to the rotational axis of the chamber defines an intermediate restriction of minimum inside diametrical dimension.

14. The apparatus of claim 13 wherein the ignition chamber includes a continuous lining provided by at least two longitudinally extending coaxially aligned segments formed of refractory material, one segment being downstream of the other segment and tapering from the open discharge end of the chamber toward said restriction within the chamber, said other segment tapering away from said restriction toward the input end of the ignition chamber.

15. In a thermal reductor system for waste disposal, a rotary housing having a longitudinally extending ignition chamber, means supporting the housing for rotation about a horizontal axis, the ignition chamber having an input end, a discharge end of enlarged size relative to its input end and a wall extending between the ends of the ignition chamber for promoting natural flow of gases, smoke and ash discharge toward said enlarged discharge end, the inside wall having a restriction intermediate the input and discharge ends of the chamber defining a barrier to liquid flow from the input to discharge ends of the chamber, and first and second burners respectively mounted at the input and discharge ends of the chamber for selectively directing flames into one or both ends of the chamber and creating a turbulent condition therein for optimized waste incineration.

16. A thermal reductor system for waste disposal comprising a housing having a horizontally disposed longitudinally extending ignition chamber supported for rotation about its longitudinal axis, the housing having an input end, a discharge end of enlarged size relative to its input end, and an inside chamber wall extending between the ends of the ignition chamber for promoting natural flow of gases, smoke and ash discharge toward said enlarged discharge end, exhaust duct means connected to the discharge end of the ignition chamber providing a passage for volatilized gases and smoke from the ignition chamber, a heat exchanger connected to the duct means for cooling gases downstream of the ignition chamber, a filter unit connected to the duct means downstream of the heat exchanger for cleaning particulates from the gases, and first and second ignition burners respectively mounted at the input end and discharge end of the ignition chamber for directing flame into the ignition chamber and for creating a turbulent condition for waste incineration.

17. A thermal reductor system for waste disposal comprising a housing having a horizontally disposed longitudinally extending ignition chamber supported for rotation about its longitudinal axis, the housing having an input end, a discharge end of enlarged size relative to its input end, and an inside chamber wall extending between the ends of the ignition chamber for promoting natural flow of gases, smoke and ash discharge toward said enlarged discharge end, waste feeding means for feeding metal bearing waste into the input end of the chamber, power driven means for rotating the ignition chamber at a predetermined angular velocity in timed relation to the waste feeding means to abrasively tumble and automatically advance waste along the length of the chamber from its input end to its discharge end, external residue collection means for receiving discharge ash and solid noncombustibles automatically released from the discharge end of the chamber during its rotation, exhaust duct means connected to the discharge end of the ignition chamber providing a passage for volatilized gases and smoke from the ignition chamber, a heat exchanger connected to the duct means for cooling gases downstream of the ignition chamber, a filter unit connected to the duct means downstream of the heat exchanger for cleaning particulates from the gases, the filter unit having filter bag means for collecting metallic oxide particles from gases passing through the filter unit.

18. The system of claim 17 wherein the filter unit includes a vertically extending housing having a lower input end connectected to the exhaust duct means, and an upper exhaust end, and wherein the filter bag means is mounted within the housing between its upper and lower ends.

* * * * *